US005269737A

United States Patent [19]

Sobotka

[11] Patent Number: 5,269,737

[45] Date of Patent: Dec. 14, 1993

[54] EXERCISING DEVICE

[76] Inventor: William A. Sobotka, P.O. Box 990, Helotes, Tex. 78023

[21] Appl. No.: 25,802

[22] Filed: Mar. 3, 1993

Related U.S. Application Data

[63] Continuation of Ser. No. 846,258, Feb. 27, 1992, abandoned.

[51] Int. Cl.[5] ..... A63B 21/04

[52] U.S. Cl. ..... 482/123; 482/130; 482/126

[58] Field of Search ..... 482/121, 122, 123, 126, 482/129, 130, 104, 142, 904

[56] References Cited

U.S. PATENT DOCUMENTS

| | | | |
|---|---|---|---|
| 393,265 | 11/1888 | Rice | 482/123 |
| 1,019,861 | 3/1912 | Titus | 482/123 |
| 1,975,021 | 9/1934 | Schmidt | 482/72 |
| 2,145,940 | 2/1939 | Marlowe | 482/72 |
| 3,740,033 | 6/1973 | Kamp | 482/123 |
| 4,072,309 | 2/1978 | Wilson | 482/130 |
| 4,521,013 | 6/1985 | Dofel | 482/130 |
| 4,705,268 | 11/1987 | Nadeau | 482/72 |
| 4,722,523 | 2/1988 | Yang | 482/126 |
| 4,746,112 | 5/1988 | Fayal | 482/73 |
| 4,852,873 | 8/1989 | O'Donnell et al. | 482/122 |
| 4,921,247 | 5/1990 | Sterling | 482/130 |
| 5,112,287 | 5/1992 | Brewer | 482/130 |

*Primary Examiner*—Richard J. Apley
*Assistant Examiner*—Lynne A. Reichard
*Attorney, Agent, or Firm*—S. Michael Bender

[57] ABSTRACT

An exercising device is designed to exercise the oblique and waist muscles of a user as well as the upper torso and mid section of the abdominal area. The exercising device creates resistance by using elastic straps attached to a special curved shoulder bar, and the straps are anchored to a combined seat and seat bar which is held steady by the exerciser's own body weight. A resistance band positionable between the exerciser's legs which is affixed to the seat allows him to apply opposite force to ensure a proper form of exercise.

4 Claims, 4 Drawing Sheets

FIG 7
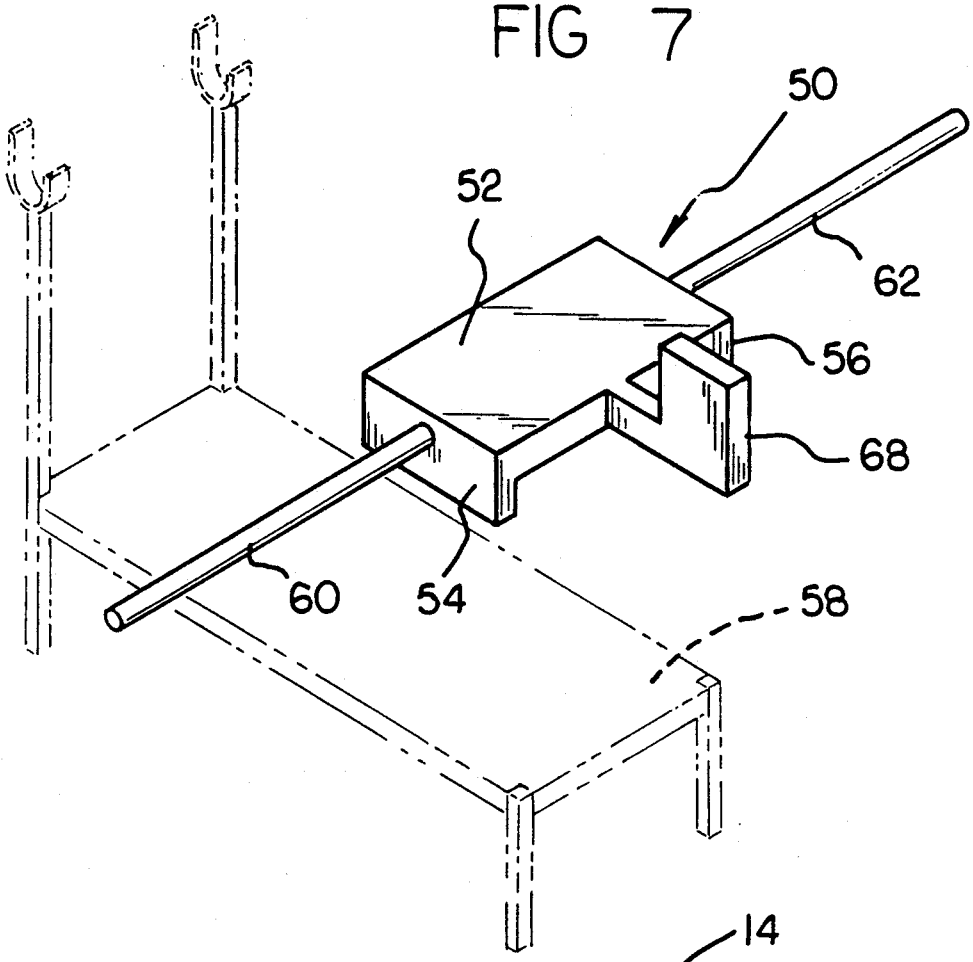
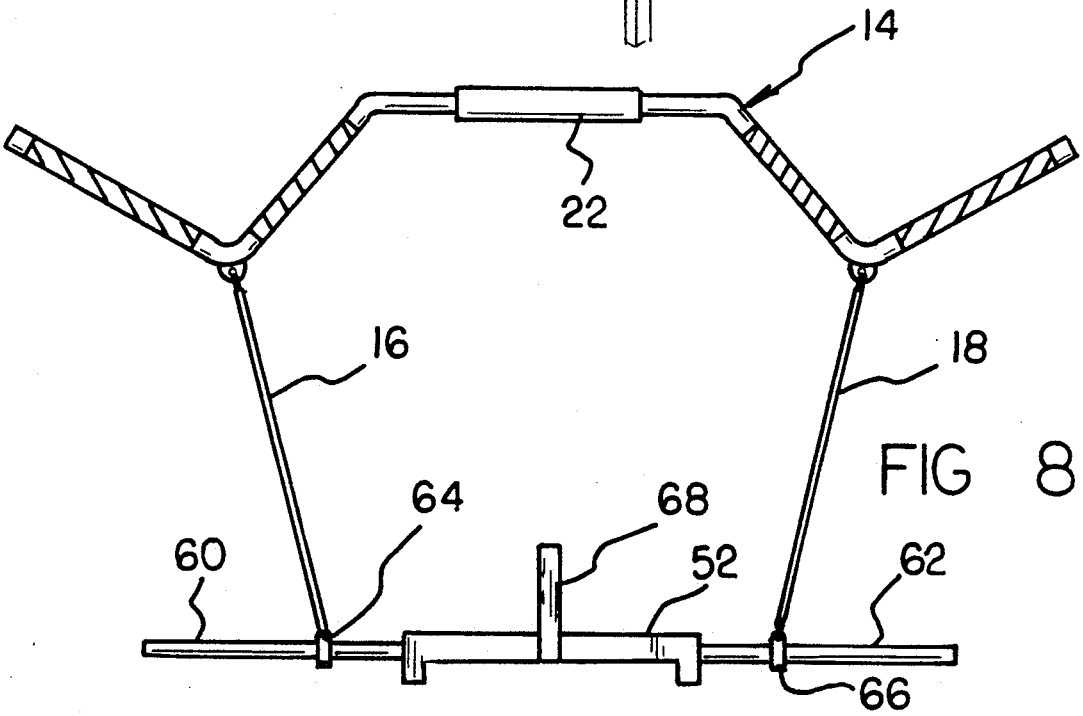
FIG 8

EXERCISING DEVICE

This application is a continuation of application Ser. No. 07/846,258, filed Feb. 27, 1992, now abandoned.

BACKGROUND OF THE INVENTION

1. Field of the Invention

The present invention relates to exercising devices and more particularly pertains to a resistance exerciser which utilizes adjustable elastic straps to control the amount of resistance provided.

2. Description of the Prior Art

The use of exercising devices which employ a twisting motion is known in the prior art. For example, U.S. Pat. No. 4,351,527, which issued to M. Crisp, Jr. on Sep. 28, 1982, discloses a double acting exerciser consisting of a hand held handle and a foot rest interconnected by a plurality of resilient spring members. An exerciser stands up on the foot plate and then twists the handle to obtain an exercising motion.

A similar concept is disclosed in U.S. Pat. No. 4,371,162, which issued to R. Hartzell on Feb. 1, 1983. The exercising device disclosed in this patent comprises a footboard on which an exerciser may stand and a pair of continuous loop elastic bands attachable to the footboard and being positionable over the exerciser's shoulders. Various twisting and stretching exercises may then be performed as desired.

A final patent of interest is U.S. Pat. No. 4,863,163, which issued to M. Wehrell on Sep. 5, 1989. This patent discloses a vertical jump exercise apparatus wherein elastic cords are fastened to the waist of a user to provide a nearly constant resistive force. The cords are fastened to a weighted footboard which stays in position due to its own weight and is not dependent upon the weight of the exerciser.

As can be appreciated, all of the above-described exercising devices are functional for their intended purposes and illustrate the fact that a crowded art exists with respect to elastic band type exercising structures. There is a continuing need for improvements to these types of devices wherein a more portable and less costly form thereof might be made available and further, any improvement in user efficiency would constitute a welcome addition. In this respect, the present invention substantially fulfills these needs.

SUMMARY OF THE INVENTION

In view of the foregoing disadvantages inherent in the known types of exercising devices now present in the prior art, the present invention provides an improved exercising device construction wherein the same utilizes an exerciser's own body weight and adjustable elastic bands to achieve an economical and efficient exercising routine. As such, the general purpose of the present invention, which will be described subsequently in greater detail, is to provide a new and improved exercising device which has all the advantages of the prior art exercising devices and none of the disadvantages.

To attain this, the present invention essentially comprises an exercising device designed to exercise the oblique and waist muscles of a user as well as the upper torso and mid section of the abdominal area. The exercising device creates resistance by using elastic straps attached to a special curved shoulder bar, and the straps are anchored to a combined seat and seat bar which is held steady by the exerciser's own body weight. A resistance pad positionable between the exerciser's legs which is affixed to the seat allows him to apply opposite force to ensure a proper form of exercise.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercising device which has all the advantages of the prior art exercising devices and none of the disadvantages.

It is another object of the present invention to provide a new and improved exercising device which may be easily and efficiently manufactured and marketed.

It is a further object of the present invention to provide a new and improved exercising device which is of a durable and reliable construction.

An even further object of the present invention is to provide a new and improved exercising device which is susceptible of a low cost of manufacture with regard to both materials and labor, and which accordingly is then susceptible of low prices of sale to the consuming public, thereby making such exercising devices economically available to the buying public.

Still yet another object of the present invention is to provide a new and improved exercising device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of a modified seat and seat bar arrangement forming a part the invention.

FIG. 8 is a front elevation view of a second embodiment of the invention which includes the seat bar assembly shown in FIG. 7.

DESCRIPTION OF THE PREFERRED EMBODIMENTS

Figure 1:
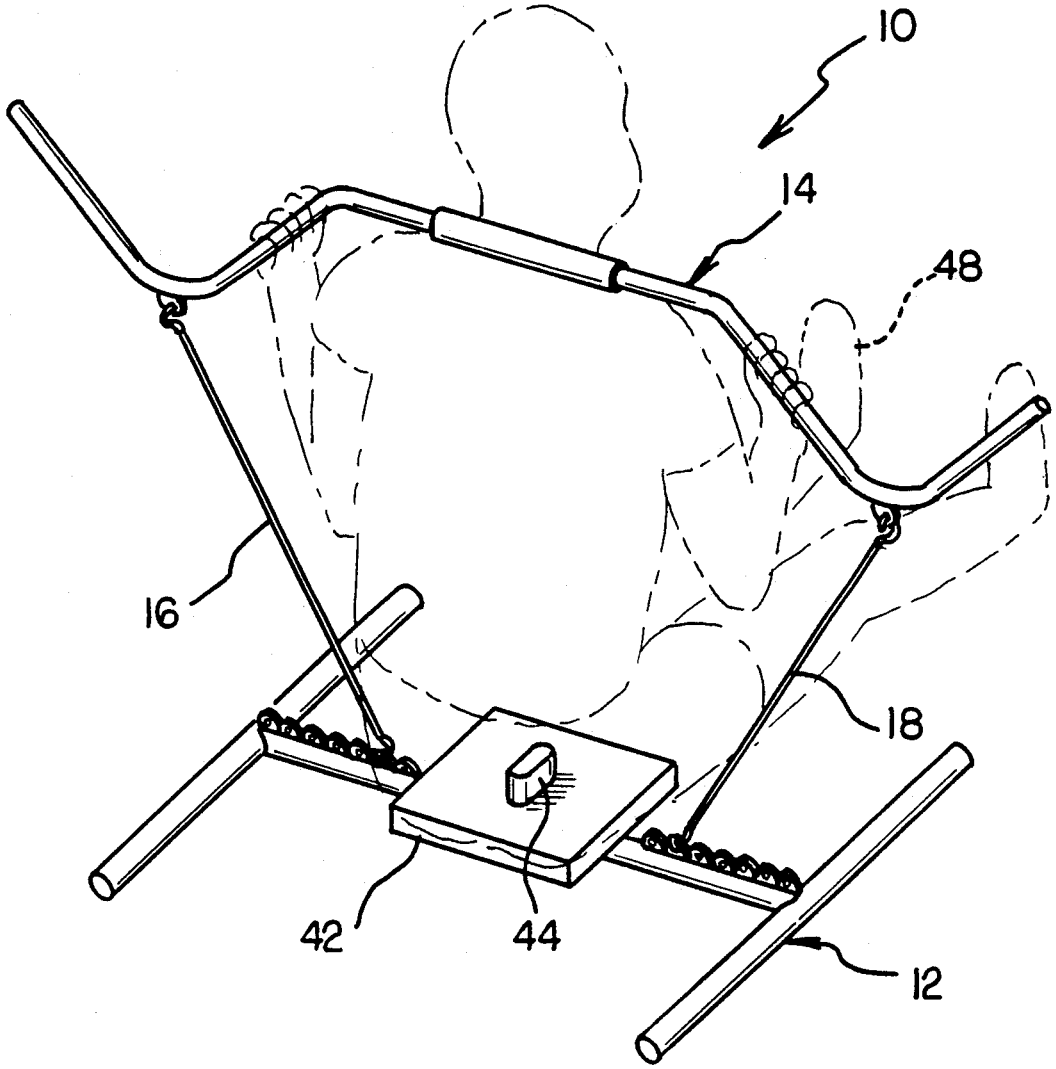
FIG. 1 is a perspective view of the exercising device comprising the present invention.

With reference now to the drawings, and in particular to FIGS. 1-5 thereof, a new and improved exercising device embodying the principles and concepts of the present invention and generally designated by the reference numeral 10 will be described.

More specifically, it will be noted that the exercising device 10 basically consists of a seat bar assembly 12, a special curved shoulder bar 14, and a pair of elastic straps 16, 18 utilized to interconnect the seat bar assembly to the shoulder bar.

Figure 2:
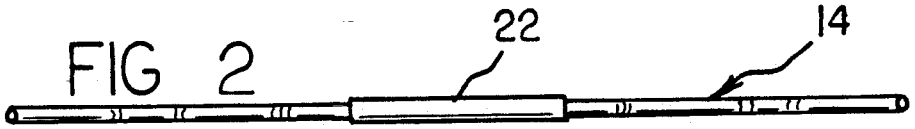
FIG. 2 is a top plan view of the shoulder bar forming a part of the present invention.
Figure 3:
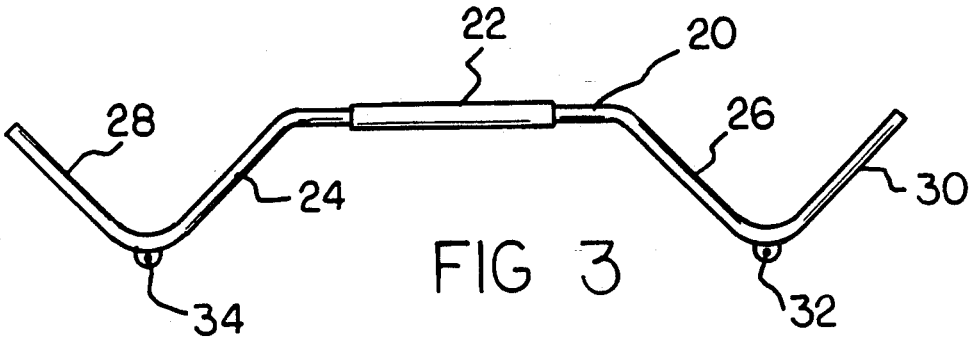
FIG. 3 is a front elevation view of the shoulder bar.

With specific reference to FIGS. 1-3, the special design of the shoulder bar 14 will be discussed. The shoulder bar assembly bar 14 essentially comprises a bar 20 having a centrally positioned neck pad 22. The bar 20 is angulated downwardly on either side of the neck pad 22 so as to form a pair of downwardly extending hand grips 24, 26, and the direction of angulation is then changed whereby the free ends of the bar are directed upwardly to form a second set of hand grips 28, 30. At the bend of the bar formed by the integral interconnection of the hand grips 26, 30, there is fixedly secured a strap engaging ring 32, and a similar ring 34 is secured to the bar at the integral junction of hand grips 24, 28.

Figure 4:
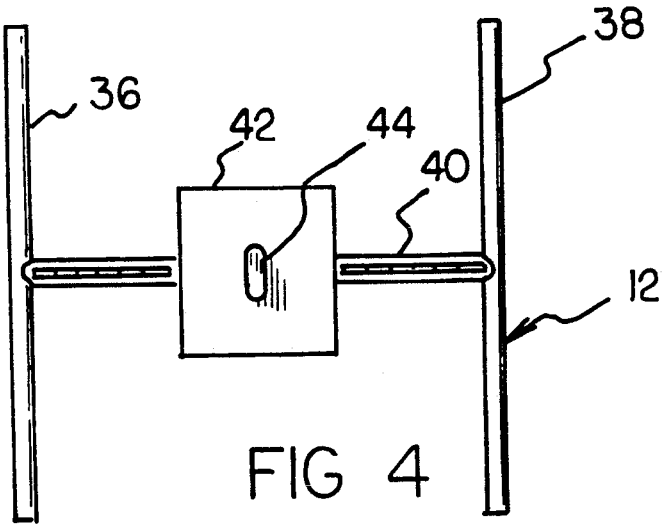
FIG. 4 is a top plan view of the seat bar forming a part of the present invention.
Figure 5:
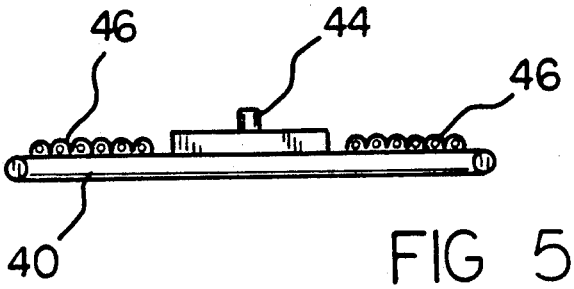
FIG. 5 is a front elevation view of the seat bar.

FIGS. 1, 4 and 5 illustrate the specific construction details of the seat bar assembly 12. In this regard, it can be seen that the assembly 12 essentially consists of a H-shaped metal bar formed from paralleledly aligned bars 36, 38 and an integral cross-extending bar 40. The bar 40 has a fixedly secured seat 42 attached at a center section thereof, and an upstanding resistance pad 44 is designed to be positioned between the legs of an exerciser who is seated upon the seat 42. The upstanding resistance pad 44 may be of a telescoping construction so as to be variable in height as desired. On opposed sides of the seat 42 are a plurality of strap retaining rings 46, all of which are welded to the cross-extending member 40.

Figure 6:
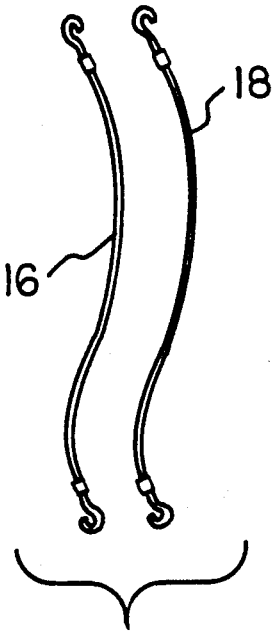
FIG. 6 is an elevation view of the elastic straps used in the combination of the present invention.

Each of the rings 46 are provided with a through-extending aperture for receiving the hooked ends of the elastic straps 16, 18 as shown in FIG. 6. Similar through-extending apertures are provided in the rings 32, 34 to receive the hooks on the remaining free hands of the straps 16, 18, thus to complete the assembly of the preferred embodiment of the invention.

FIG. 1 illustrates the manner of using the preferred embodiment of the invention. In this connection, it can be seen that a user 48 may sit upon the seat 42 with the resistance pad 44 positioned between his legs. By squeezing his legs together, rotatable movement of his buttocks relative to the seat 42 is prevented. The elastic band 16, 18 are appropriately attached to the strap connectors 32, 34 on the shoulder bar 14 and then are adjustably attached to one of the many available strap connectors 46 forming a part of the seat bar assembly 12. As is apparent from reference to FIG. 1, attaching the straps 16, 18 closer to the sides of the seat 42 will result in a less exercising resistance for a user 48 in as much as the effective links of the straps 16, 18 are increased. A greater exercise resistance is achieved by moving the straps 16, 18 outwardly towards the paralleledly aligned side bars 36, 38. With the shoulder bar 14 positioned over the shoulders of a user 48 and the neck pad 22 being positioned against the user's neck, a twisting exercising activity can be undertaken. This type of exercise works the oblique and waist muscles, as well as the upper torso and midsection of the abdominal area.

FIG. 7 of the drawings illustrates a modified seat bar assembly which is generally designated by the reference numeral 50. In this construction, the assembly 50 essentially comprises a rigid seat structure 52 which is of a planar rectangular shape and which has downwardly extending edges 54, 56 at opposed ends thereof. The seat assembly 50 is positionable over a conventional exercise bench 58 so as to provide a seat for an exerciser, and the downwardly extending edges 54, 56 serve to lock the assembly 50 in position on the exercise bench 58 during a use thereof.

Fixedly secured to and extending outwardly from the edges 54, 56 are a pair of respective rigid seat bars 60, 62. As shown in FIG. 8, these bars 60, 62 facilitate the slidable positioning of respective rings 64, 66 along their respective axes. This of course, facilitates an adjustable tensioning of the elastic strips 16, 18 inasmuch as the respective rings 64, 66 are attached to free ends thereof.

Also illustrated in both FIGS. 7 and 8 is an L-shaped resistance arm 68 integrally or otherwise fixedly secured to the seat 52 along a front portion thereof. This resistance arm 68 functions in the manner of the resistance pad 44 described in conjunction with the first embodiment of the invention wherein a user sitting upon the seat 52 positions the resistance arm between his legs to lock his body in position while exercising.

Figure 9:
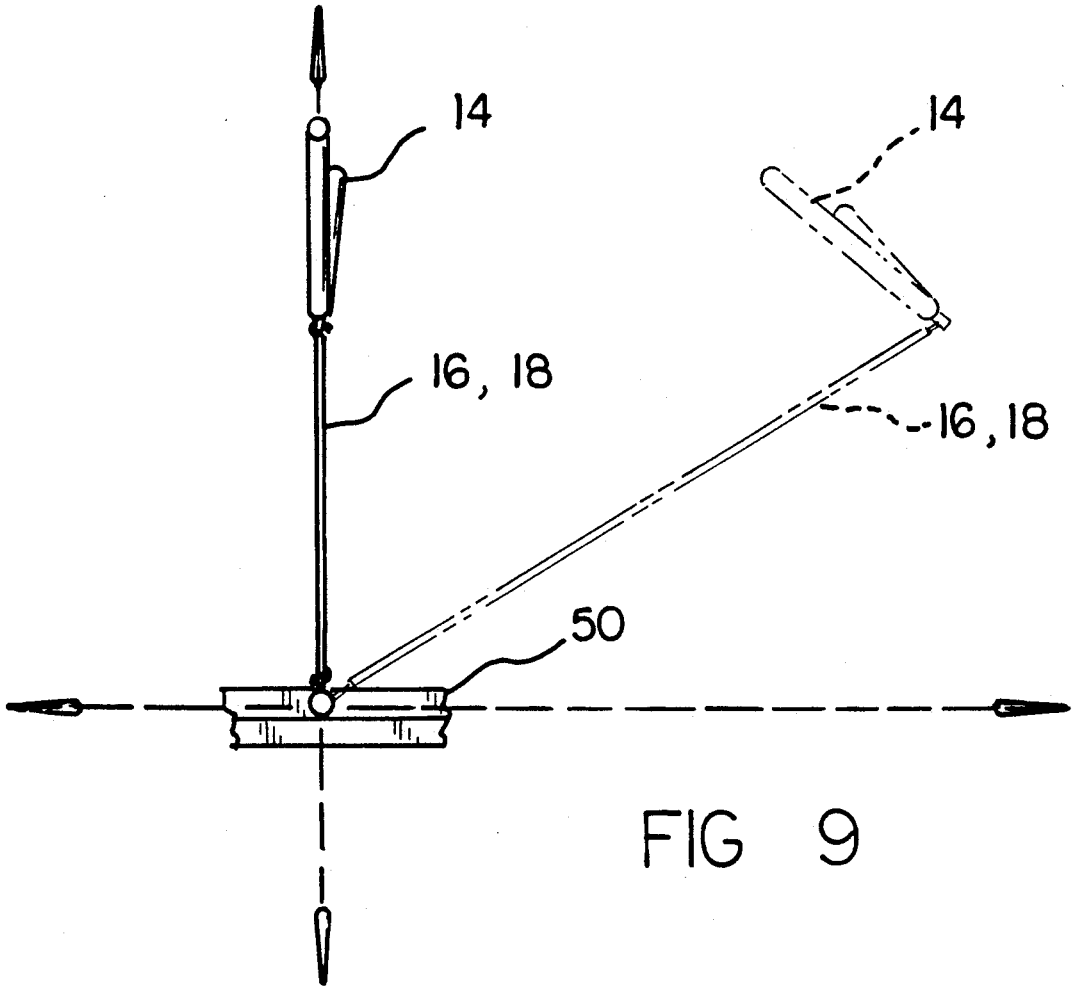
FIG. 9 is a schematic representation of how the invention functions from a side elevation view.
Figure 10:
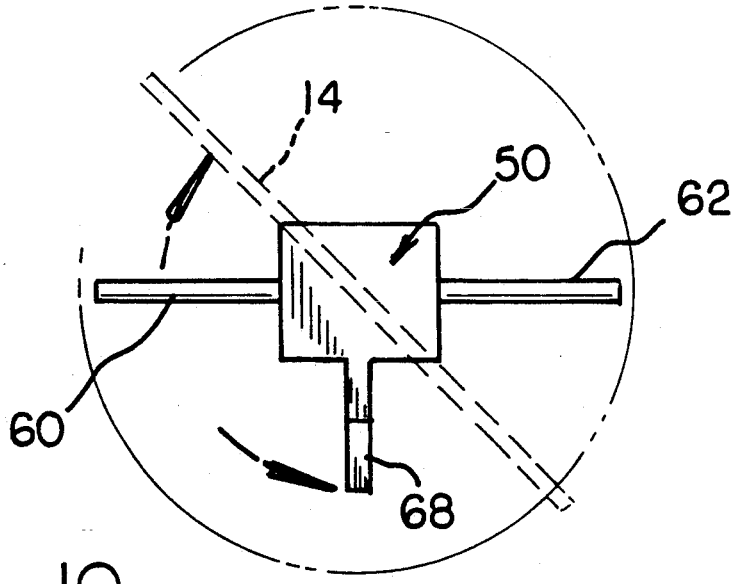
FIG. 10 is a schematic representation of how the invention functions from a top plan view.

FIGS. 9 and 10 of the drawings have been provided for the purpose of illustrating the exercising principle behind both embodiments of the inventions. More particularly, FIG. 9 illustrates how the elastic bands 16, 18 stretch so as to provide a strong exercising force when the exercising bar 14 is positioned upon an exerciser's shoulders. By the same token, FIG. 10 illustrates the rotative motion achieved on an exerciser's body when the bar 14 is positioned upon his shoulder and when his lower body is locked in position on the seat assembly 50 through a positioning of the resistance arm 68 between his legs.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved exercising device comprising:

seat means upon which an exerciser may sit while exercising, said seat means including a frame member and a seat member supported intermedially on said frame member such that first and second portions of said frame member extend laterally from opposed sides of said seat member and said seat member is adapted to support an exerciser's buttocks with the legs of said exerciser extending substantially perpendicular to said laterally extending first and second portions of said frame member;

shoulder bar means positionable across the shoulders of said exerciser; and a pair of elastic strap means for providing an exercising resistance and being utilized to interconnect said seat means frame member with said shoulder bar means at a pair of spaced locations along said shoulder bar means and along said frame member respectively, one of said locations being situated on said first frame member portion and another of said locations being situated on said second frame member portion, each of said first and second frame member portions further including elastic strap means length adjustment means, said length adjustment means comprising a plurality of elastic strap means connectors attached to and extending longitudinally along said first and second portions of said seat bar means frame member on opposite lateral sides of said seat member supported intermedially thereon whereby the resistance afforded by said elastic strap means may be adjusted by selectively changing the connectors used to attach said pair of elastic strap means to said frame member, wherein said seat member further comprises an upstanding post fixedly attached substantially centrally thereof, said upstanding post adapted to be gripped by the legs of an exerciser positioned on said seat means to prevent unintended twisting of the exerciser's body during use of said device.

2. A new and improved exercising device comprising:

seat means upon which an exerciser may sit while exercising, said seat means including a seat member and first and second portions extending laterally from opposed sides of said seat member such that said seat member is adapted to support an exerciser's buttocks with the legs of said exerciser extending substantially perpendicular to said laterally extending first and second portions;

shoulder bar means positionable across the shoulders of said exerciser; and a pair of elastic strap means for providing an exercising resistance and being utilized to interconnect said seat means with said shoulder bar means at a pair of spaced locations along said shoulder bar means and said seat means, respectively, one of said locations being situated on said first laterally extending portion and another of said locations being situated on said second laterally extending portion, each of said first and second laterally extending portions comprising an axially extending bar having one end attached to said seat member and another oppositely extending free end, and elastic strap means length adjustment means, said length adjustment means comprising connector means on each of said elastic strap means, respectively, each said connector means being selectively slidably positionable on its corresponding axially extending bar between the ends thereof whereby the resistance afforded by said elastic strap means may be adjusted by selectively sliding each connector to a different position on its corresponding axially extending bar.

3. The exercising device of claim 2 wherein each said connector means comprises a ring attached to each said elastic strap means, said ring adapted to be fitted on the free end of its corresponding bar and slidably positionable along the axis thereof.

4. A new and improved exercising device comprising:

seat means upon which an exerciser may sit while exercising, seat means including a seat member and first and second portions extending laterally from opposed sides of said seat member such that said seat member is adapted to support an exerciser's buttocks with the legs of said exerciser extending substantially perpendicular to said laterally extending first and second portions;

shoulder bar means positionable across the shoulders of said exerciser; and a pair of elastic strap means for providing an exercising resistance and being utilized to interconnect said seat means with said shoulder bar means at a pair of spaced locations along said shoulder bar means and said seat means, respectively, one of said locations being situated on said first laterally extending portion and another of said locations being situated on said second laterally extending portion, elastic strap means length adjustment means, said length adjustment means comprising connector means on each of said elastic strap means, said connector means being selectively positionable on said first and second laterally extending portions, respectively, whereby the resistance afforded by said elastic strap means may be adjusted by selectively positioning each said connector means to a different position on said first and second laterally extending portion, respectively, and wherein said seat means further includes a pair of opposed laterally spaced ledges extending perpendicular to said first and second laterally extending portions whereby said laterally spaced edges are adapted to attach said seat means on an exercising bench with said first and second portions extending laterally on opposite sides of said bench, respectively.

* * * * *